United States Patent [19]

Thielen

[11] B 3,991,431

[45] Nov. 16, 1976

[54] MOP FRAME ASSEMBLY

[75] Inventor: James E. Thielen, New Brighton, Minn.

[73] Assignee: Minnesota Mining and Manufacturing Company, St. Paul, Minn.

[22] Filed: Sept. 3, 1974

[21] Appl. No.: 502,667

[44] Published under the second Trial Voluntary Protest Program on February 24, 1976 as document No. B 502,667.

[52] U.S. Cl. ..... 15/147 A; 15/228; 248/226 E

[51] Int. Cl.[2] ..... A47L 13/254

[58] Field of Search ..... 15/147 R, 147 A, 148, 15/116 A, 119 A, 176, 209 AH, 210 R, 228, 244 R, 244 A, 244 CH, 400, 403; 248/226 E

[56] References Cited

UNITED STATES PATENTS

| | | | |
|---|---|---|---|
| 2,618,003 | 11/1952 | Robey | 15/176 |
| 2,632,192 | 3/1953 | Mallory | 15/119 A |
| 2,840,839 | 7/1958 | Benedetti | 15/244 A |
| 3,012,264 | 12/1961 | Nash | 15/144 A X |
| 3,616,481 | 11/1971 | Van Spronsen | 15/244 R |
| 3,778,860 | 12/1973 | Thielen | 15/147 A |

FOREIGN PATENTS OR APPLICATIONS

| | | | |
|---|---|---|---|
| 1343/31 | 5/1932 | Australia | 15/228 |

*Primary Examiner*—Daniel Blum

*Attorney, Agent, or Firm*—Alexander, Sell, Steldt and DeLaHunt

[57] ABSTRACT

A mop frame assembly having an improved removable mop frame which firmly holds a mop pad in place yet permits easy removal. The mop frame is formed of a rigid base member having a pair of opposed S-shaped elongate stiff but flexible engaging members which mechanically firmly but removably engage a portion of a body member. The body member is attached to a mop handle holder, preferably by means of a positionable universal joint, while the base member is permanently fastened to a mop pad.

5 Claims, 5 Drawing Figures

MOP FRAME ASSEMBLY

BACKGROUND OF THE INVENTION

The invention relates to a mop frame assembly having a removable mop pad holding member.

Mop frame assemblies having holding means for temporarily holding a mop pad have been known for some time. Perhaps the most popular holding means is the metal clamp-type holder which is utilized to hold a mop pad consisting of a plurality of elongate fibrous strands sewn on either side of an elongate fabric strip. This type of clamp is generally characterized by having metal bars that are forced together by means of a screw clamp onto the cloth strip to prevent its removal.

While such holding means is suited for mop pads of the aforementioned type, it is not suited for mop pads which are shaped fibrous structures such as synthetic sponges and low-density fibrous pads such as that disclosed in U.S. Pat. No. 2,958,593. These shaped fibrous mop pads typically have planar working surfaces which would be distorted by clamping. While at first glance other simple mechanically fastening devices may be thought to provide an adequate solution to the problem, such devices have heretofore required complex mechanisms and/or structural modifications of the mop pad. U.S. Pat. No. 3,778,860 discloses a highly commercially successful improved mop frame having stiff fibers which intermesh and intertangle with the fibers of a fibrous mop pad to releasably secure it to the mop frame. The fiber mop pad holding means is unable to hold all low density fibrous mop pads, however, especially those having an extremely open nature and some pads are therefore easily dislodged. Prior to the present invention, no suitable simple means of temporarily but firmly fastening such shaped fibrous mop pads to a mop frame was known.

SUMMARY OF THE PRESENT INVENTION

The invention provides a mop frame assembly having an improved mop frame for securely removably attaching shaped fibrous mop pads. The mop pad is securely permanently fastened to a pad-holding base member which is securely removably engageable with a base-holding body member which in turn is permanently fastened to a mop handle holder. The mop pad may be held in fixed position while it is being used and can easily be detached from the mop frame assembly whenever desired.

BRIEF DESCRIPTION OF THE DRAWINGS

Understanding of the invention will be facilitated by referring to the accompanying drawing, in which like numbers refer to like parts in the several views and in which.

DESCRIPTION OF THE PREFERRED EMBODIMENT

Figure 1:
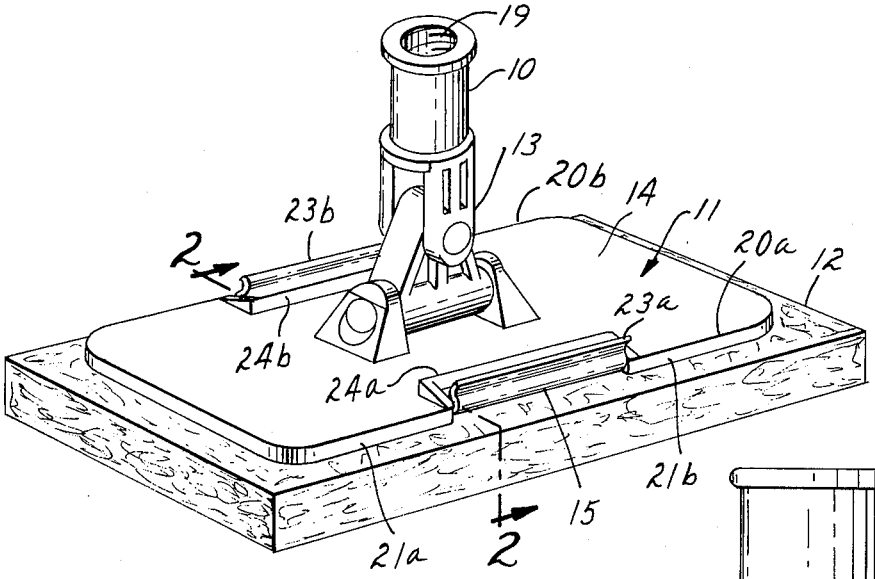
FIG. 1 is a perspective view of a mop frame assembly embodying the principles of the invention.
Figure 4:
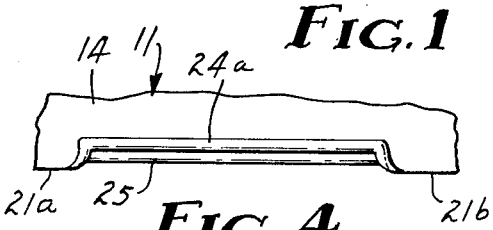
FIG. 4 is a top view of a portion of the body member of the assembly depicted in FIG. 1.
Figure 5:
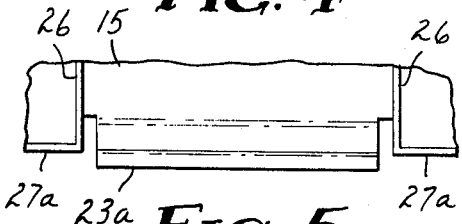
FIG. 5 is a top view of a portion of the base member of the assembly depicted in FIG. 1.
Figure 2:
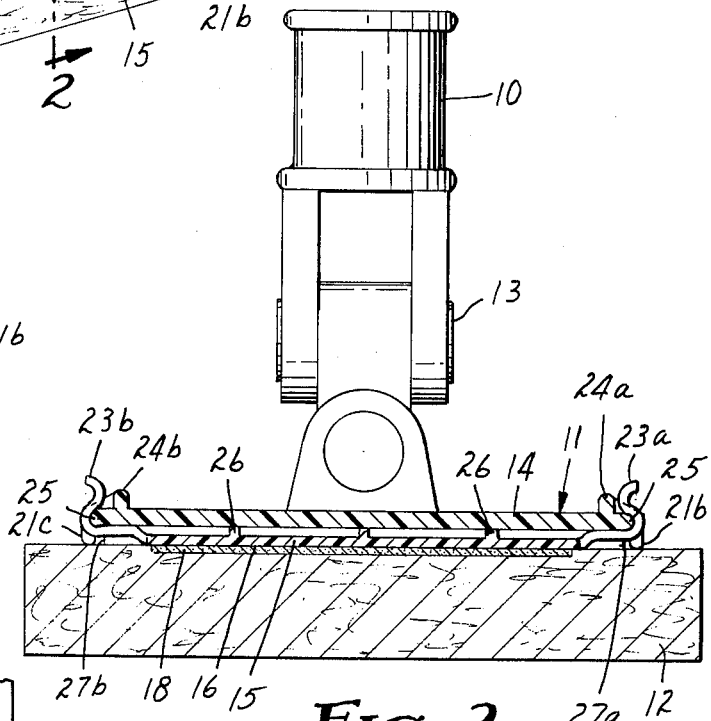
FIG. 2 is a side cross-sectional view of the assembly of FIG. 1 taken along section line 2—2.
Figure 3:
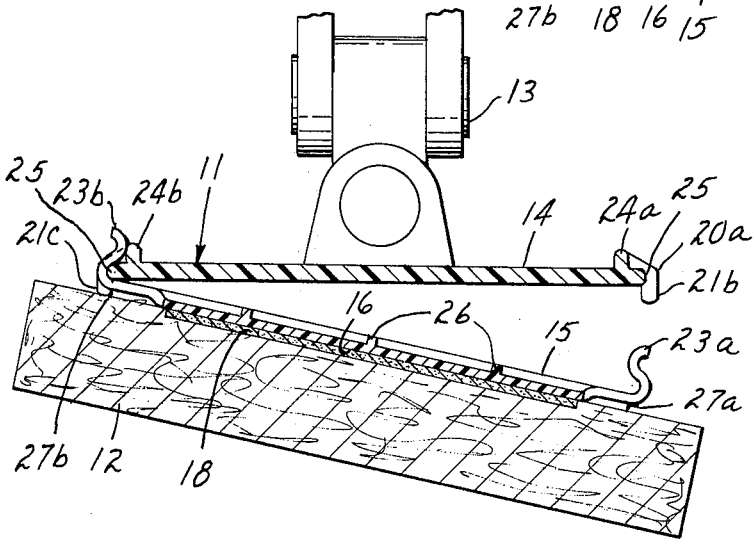
FIG. 3 is a side cross-sectional view of the assembly of FIG. 1 taken along section line 2—2 with parts partially disconnected for ease of display and explanation.

The mop frame assembly of the invention comprises, as depicted in FIG. 1, handle holder 40 attached to mop frame 11 to which in turn may be attached shaped fibrous mop pad 12. Preferably, handle holder 10 is connected to mop frame 11 by means of a positionable universal joint 13. A preferred positionable universal joint is that which is depicted, it being further described in U.S. Pat. No. 3,778,860, the disclosure of which is incorporated herein by reference.

Mop frame 11 comprises a base member 15 which is removably engageable with a body member 14. Base member 15 has lower surface 16 which is of a configuration which preferably corresponds to the surface of a fibrous mop pad to which it is to be attached, usually the surface opposite the working surface of the mop pad. Generally, both the working surface and the attaching surface of the mop pad will be planar, since most shaped fibrous mop pads (e.g., synthetic sponges and low-density fibrous abrasive products of the type described in U.S. Pat. No. 2,958,593) have rectangular shapes. The fibrous mop pad 12 is permanently attached to mop frame 11 by any suitable fastening means 18. A convenient fastening means is an adhesive composition which adheres well to the mop frame and to the fibrous pad and is resistant to soapy water and organic solvents utilized in conventional cleaning compositions. A useful adhesive composition is that sold under the trade designation "Eastobond L-8080-148AS" by Eastman Chemical Products Inc. Mechanical fastening means may also be utilized but they are less desirable because they are generally more complex and/or expensive and may require structural modifications of the pad.

Handle holder 10 has an upper end which includes a socket 19, which may have internal threads, for attaching an externally threaded complementary mop handle (not shown). If desired, socket 19 can be replaced by any available type of handle holding means.

Body member 14 of mop frame 11 is formed of a suitable rigid material with substantially parallel opposed straight edge portions 20*a* and 20*b*. Along parallel opposed edge portions 20*a* and 20*b* are parallel erect depending flanges 21*a*, 21*b*, 21*c*, and 21*d*. flange 21*d* cannot be seen in the figures.) These flanges are directed in the same direction and commence on either side of an intermediate portion of each of the edge portions. Edge portions 20*a* and 20*b* are each slotted to provide a shallow recessed intermediate portion 25 which is parallel to edge 20*a* and 20*b*. Preferably, the height of each of flanges 21*a*, 21*b* , 21*c* and 21*d* is the same and slightly greater than the thickness of the adjacent portion of body member 14. The width of flanges 21*a*, 21*b*, 21*c* and 21*d* is the same and may be any suitable size although it is preferred to be relatively narrow for the sake of economy. A suitable width is 1/16 inch.

Base member 15 is of a suitable rigid material and has a pair of parallel upstanding opposed elongate S-shaped stiff but flexible engaging members 23*a* and 23*b* which are positioned to engage recessed intermediate edge portions 25 between the intermediate ends of the flange portions 21*a*, 21*b*, 21*c* and 21*d*. The curved portions of the engaging members 23*a* and 23*b* adjacent base member 15 are spaced apart a distance corresponding to the spacing between the edge portions 25 of the body member 14. The length of engaging members 23*a* and 23*b* corresponds to the length of recessed intermediate portions 25. Base member 15 has substantially parallel opposed edge portions 27*a* and 27*b* which are spaced apart so that it fits loosely within flanges 21*a*, 21*b*, 21*c* and 21*d* but close enough to permit edge portions 27*a* or 27*b* to come into contact with its adjacent flange portion when the opposite S-shaped engaging member is disengaged. Such contact prevents the body member 14 from completely disengaging from base member 15.

Body member 14 may also have suitable elongate ridge portions 24*a* and 24*b* adjacent the full length of intermediate portions 25, but spaced slightly from edge portions 20*a* and 20*b*, and directed in an opposite direction of that of flanges 21*a*, 21*b*, 21*c* and 21*d* to intercept the outwardly curved portions of the free ends of S-shaped engaging members 23*a* and 23*b* to limit the distance of travel of adjacent portions of the base and the body when one S-shaped engaging member is disengaged and also to add rigidity to member 14.

Base member 15 may also have reinforcing structural modifications, such as reinforcing ribs 26 to give it structural strength.

Either body member 14 or base member 15 may be attached to the handle holder 10, but it is preferred that body member 14 be so attached since that choice results in S-shaped engaging members 23*a* and 23*b* being directed toward handle holder 10 and away from mop pad 12. This result is preferred if mop pad 12 is wider than the space between engaging members 23*a* and 23*b*.

As thus described, mop frame body member 14 and base member 15 fit firmly together when joined, yet they are capable of being separated by appropriate outward pressure on both S-shaped engaging members 23*a* and 23*b*. It should be noted that outward pressure on one of these engaging members will be insufficient to free the base member completely. Rather than being free, the two parts come into hinged contact until the remaining engaging member is appropriately outwardly pressed. Such an advantage will be appreciated when one of the S-shaped members become dislodged and, rather than the mop pad/base member combination falling free (possibly in a pail of dirty scrub water), the parts remain connected and can be quickly re-engaged.

The mop frame assembly is made from materials which provide resistance to the environment in which the mop is to be used, as well as structural strength. Preferably, the parts of the mop frame assembly are constructed of acrylonitrile-butadiene-styrene copolymer but may be of polyacetal, nylon, metal, etc.

A preferred embodiment of this invention having been described and illustrated, it is to be realized that modifications thereof may be made without departing from the broad sphere and scope of this invention as defined in the appended claims.

What is claimed is:

1. A mop frame assembly comprising:

a mop frame, a handle holder attached to said mop frame, said handle holder and mop frame being formed of materials that are resistant to normal cleaning solutions, and said mop frame comprising:

a rigid body member and a rigid base member removably engageable with said body member wherein said body member is formed with opposed parallel edge portions and having parallel depending flange portions along said edge portions, said flange portions being directed in the same direction and commencing on either side of an intermediate portion of each of said edge portions, the edge portions of said intermediate portions being slightly inset from and parallel to said parallel edge portions of said body member, said base member having (1) a pair of parallel upstanding opposed elongate S-shaped stiff but flexible engaging members positioned to engage said intermediate edge portions between the intermediate ends of said flange portions, the curved portion of said engaging members adjacent said base member being spaced apart a distance corresponding to the spacing between edge portions of said body member (2) and substantially parallel opposed edge portions on said base member which are spaced apart so that said base member fits loosely within the area defined by said flange portions but close enough to permit one of said base member edge portions to come into contact with an adjacent body member flange portion when the opposite S-shaped engaging member is disengaged from said body member to prevent the base member from being completely disengaged, one of said body member or said base member being attached to said handle holder.

2. The mop frame assembly of claim 1 wherein said mop frame contains a means for permanently attaching a mop pad.

3. The mop frame assembly of claim 2 wherein said mop pad attachment means is an adhesive composition.

4. The mop frame assembly of claim 1 wherein said handle holder is attached to said mop frame by means of a positionable universal joint.

5. A mop frame comprising:

a rigid body member and a rigid base member removably engageable with said body member wherein said body member is formed with opposed parallel edge portions and having parallel depending flange portions along said edge portions, said flange portions being directed in the same direction and commencing on either side of an intermediate portion of each of said edge portions, the edge portions of said intermediate portions being sligthly inset from and parallel to said parallel edge portions of said body member, said base member having (1) a pair of parallel upstanding opposed elongate S-shaped stiff but flexible engaging members positioned to engage said intermediate edge portions between the intermediate ends of said flange portions, the curved portion of said engaging members adjacent said base member being spaced apart a distance corresponding to the spacing between edge portions of said body member (2) and substantially parallel opposed edge portions on said base member which are spaced apart so that said base member fits loosely within the area defined by said flange portions but close enough to permit one of said base member edge portions to come into contact with an adjacent body member flange portion when the opposite S-shaped engaging member is disengaged from said body member to prevent the base member from being completely disengaged.

* * * * *